US005628210A

United States Patent [19]

Mista et al.

[11] Patent Number: 5,628,210

[45] Date of Patent: May 13, 1997

[54] WARP KNITTING METHOD, MACHINE, AND FABRIC MADE THEREFROM

[75] Inventors: Kresimir Mista, Heusenstamm; Hans-Jurgen Hohne, Hainburg, both of Germany

[73] Assignee: Karl Mayer Textilmaschinenfabrik GmbH, Obertshausen, Germany

[21] Appl. No.: 426,887

[22] Filed: Apr. 24, 1995

[30] Foreign Application Priority Data

Apr. 28, 1994 [DE] Germany ..... 44 14 876.3

[51] Int. Cl.[6] ..... D04B 23/00; D04B 21/00

[52] U.S. Cl. ..... 66/203; 66/195

[58] Field of Search ..... 66/203, 204, 205, 66/195, 192, 194, 196

[56] References Cited

U.S. PATENT DOCUMENTS

| | | | |
|---|---|---|---|
| 4,549,414 | 10/1985 | Zolini et al. | 66/214 |
| 4,841,750 | 6/1989 | Zorini | 66/204 |
| 5,150,587 | 9/1992 | Bergmann | 66/204 |
| 5,172,570 | 12/1992 | Wade et al. | 66/195 |

FOREIGN PATENT DOCUMENTS

| | | |
|---|---|---|
| 0583631 | 2/1994 | European Pat. Off. . |
| 4020550 | 10/1991 | Germany . |
| 4316396 | 9/1994 | Germany . |

OTHER PUBLICATIONS

Copy of German Office Action, Dec. 29, 1994.

*Primary Examiner*—C. D. Crowder
*Assistant Examiner*—Larry D. Worrell, Jr.
*Attorney, Agent, or Firm*—Omri M. Behr, Esq.

[57] ABSTRACT

In a method for manufacturing a warp knitted fabric, the guides can also be displaced by one needle space (pitch) in addition to the overlap and underlap shog of the guide bar, so that the guides are not only selectively displaceable during the underlap shog, but also selectively during the overlap shog. A warp knitting machine for the purpose of carrying out the method comprises at least one thread system which consists of pattern threads laid in intermixed, varying patterns. These pattern threads have underlaps of n, n+1 and n−1 needle spaces and can produce a float and/or a twill. The number of pattern possibilities can be increased in this manner.

7 Claims, 2 Drawing Sheets

WARP KNITTING METHOD, MACHINE, AND FABRIC MADE THEREFROM

FIELD OF THE INVENTION

The invention relates to a method for manufacturing a warp knitted fabric on a warp knitting machine, wherein: (a) the guides of at least of one guide bar, can be displaced by one needle space to augment the overlap and underlap shogs of the guide bar, and (b) in each operational cycle in dependence upon a desired pattern, guides are selected, which are then displaced during the underlap shog.

The invention also relates to a warp knitting machine for carrying out this method and having at least one guide bar, which can be displaced as a whole unit by a displacement control device. The machine also has a control device for individually displacing the guides by one needle space and a program controlling element which in each operational cycle predetermines in dependence upon the pattern, a selection of guides, which can be displaced by the control device during the underlap shog.

The invention further relates to a warp knitted fabric made according to the aforementioned method or on the aforementioned warp knitting machine. The fabric has one fabric base and at least one thread system, which consists of pattern threads laid in intermixed, varying patterns, which pattern threads have underlaps of n, n+1 and needle divisions n−1.

DESCRIPTION OF RELATED ART

This type of prior art is known from the conventional warp knitting machines having a Jacquard control. As is evident from FIG. 3 of DE-C-40 20 550, the Jacquard guides can be additionally displaced by one needle space during the underlap shog of the associated guide bar. If the guide bar is displaced in the sense of patterning a tricot, then it is also possible by displacing the guide in the region of one or the other reversing point, to pattern also a pillar or a cloth. This does exhaust, however, the pattern possibilities of the Jacquard guide. It generally applies that in the case of the underlap shog of n needle pitches, three types of patterns can be achieved with needle pitches of n, n+1 and n−1.

Displaceable guides carried on piezoelectric bending transducers are known from EP-A-O 538 631.

SUMMARY OF THE INVENTION

In accordance with the illustrative embodiments demonstrating features and advantages of the present invention, there is provided a method for manufacturing a warp knitted fabric. The method employs a warp knitting machine having on at least one guide bar a plurality of guides displaceable by one needle space additional to an overlap and underlap shog of the guide bar. The method includes the step of shogging the guide bar during an overlap and underlap interval in each operational cycle. Another step is displacing during the underlap interval in each operational cycle, a first group of the guides selected in dependence upon a predetermined pattern. The method also includes the step of displacing during the overlap interval in each operational cycle, a second group of the guides in dependence upon the predetermined pattern.

In accordance with another aspect of the same invention, there is provided a warp knitting machine having at least one guide bar. The machine also has a displacement control device coupled to the guide bar for displacing the guide bar as a unit. Also included is a plurality of guides mounted on the guide bar for allowing individually selectable displacements of one needle space. The machine also includes a control device coupled to the guides and having a program controlling unit for selecting in each operational cycle in dependence upon a predetermined pattern, ones of the guides. The program controlling unit can select in each operational cycle a first and second group of the guides to be displaced by the control device during underlap and overlap shogs, respectively.

In accordance with still another aspect of the invention, there is provided a warp knitted fabric including a fabric base, and at least one thread system. This thread system has pattern threads laid in intermixed, varying patterns. The pattern threads have underlaps of n, n+1 and n−1 needle spaces. The pattern threads are selectively laid as a float, a twill, or a float and twill.

An object of the present invention is to increase the variety of patterns. This object is achieved in accordance with the present invention by selecting in each operational cycle, in dependence upon a pattern, a second selection of guides, which are displaced during the overlap shog.

Such additional pattern possibilities can flow from the existence of two possible ways of displacing the guides in each operational cycle. On the basis of the conventional overlap shog having one needle space, this shog can be compensated by displacing the guide so that the thread is not bound in but rather extends as a float, or doubles, so that a twill stitch construction is produced. Still, with the aid of a guide bar, one can provide an overlap shogging of two or more needle spaces and to shorten or lengthen this by one needle space by correspondingly displacing individual guides.

Regarding the machine, the object is achieved with a program controlling unit that predetermines in each operational cycle, a second selection of guides, which can be displaced during the overlap shogging by the control device.

Regarding the warp knitted fabric of the type mentioned in the introduction, objects are achieved in accordance with the present invention with preferred pattern threads that are laid additionally as a float and/or a twill. Instead of the previous three types of patterns, five different patterns may be produced. In the simplest case, the pattern threads of a thread system are formed as a cloth, a tricot, pillar and float and/or a twill.

BRIEF DESCRIPTION OF THE DRAWINGS

The invention is further explained hereinafter with reference to the embodiments illustrated by way of example in the accompanying drawings, in which.

DETAILED DESCRIPTION OF THE PREFERRED EMBODIMENTS

Figure 1:
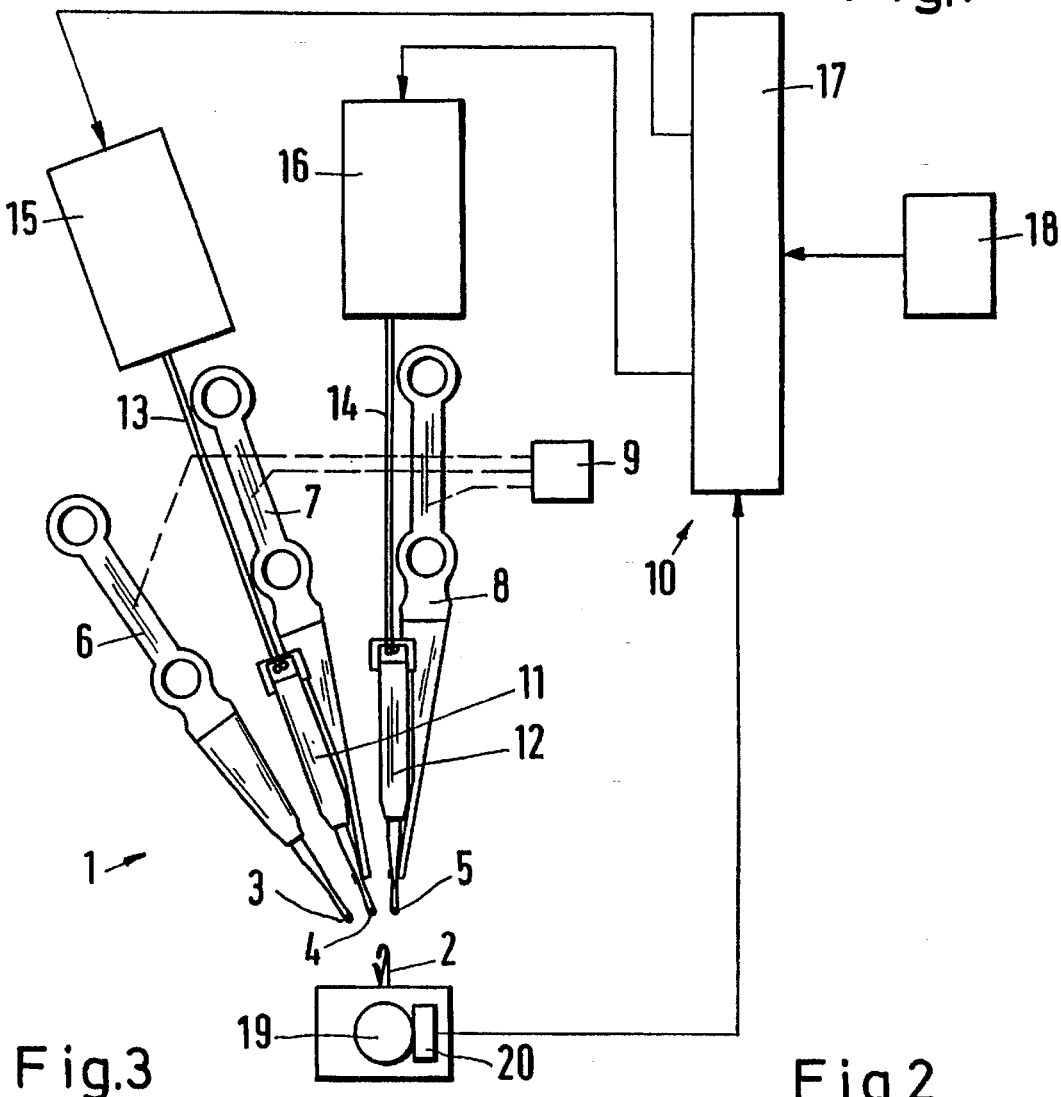
FIG. 1 is a schematic illustration of a warp knitting machine in accordance with the principles of the present invention.

FIG. 1 illustrates schematically a warp knitting machine 1, which comprises a row of knitting needles 2, and three rows of guides 3, 4 and 5 which swing between the knitting needles 2. The guides sit in each case on guide bars 6, 7 and 8, which can reciprocate in the conventional manner by virtue of a displacement control device 9 in the direction of their longitudinal axis, i.e., perpendicular to the plane of the drawing, in order to produce the desired underlap and overlap motions. The guides 3 have the same pitch as the knitting needles 2. The guides 4 and 5 comprise in each case a double pitch and are staggered with respect to each other. Moreover, guides 4 and 5 can be displaced in each case by one knitting needle space by virtue of a control device 10.

In practical embodiments, control device 10 may have piezoelectric bending transducers 11 and 12 carrying the displaceable guides 4 and 5. With such small mass, the guides can be adjusted rapidly. High-speed warp knitting machines can therefore implement a selection of two patterns. Guides carried on piezoelectric bending transducers are known from EP-A-0 538 631. Control device 10 provides for each of the guides 4 and 5, piezoelectric bending transducers 11 and 12, which can be controlled by way of electric control lines 13 and 14. These control lines are connected to the outputs of pulse generators 15 and 16 in such a manner as to convey signals.

Preferably, the piezoelectric bending transducers are designed with voltage-holding capacitance, to be driven by the control device 10 with electric pulse generators 15 and 16. Generator 15 and 16, in dependence upon the program controlling unit 17, applies electric pulses to the bending transducers of selected guides. Consequently, a short pulse is sufficient to displace the guides in the desired manner. The new position is maintained owing to the capacitive effect until a new pulse is supplied for the return displacement.

Program controlling unit 17 (e.g., a microprocessor), is connected to a pattern storage device 18 (e.g., RAM memory). Unit 17 passes pattern data to the pulse generators 15 and 16 in dependence upon the angular rotational position of the main shaft 19 of the warp knitting machine. Pulse generators 15 and 16 subsequently excite in each case a selected number of bending transducers 11 and 12 by emitting a corresponding electrical pulse. To this end, program controlling unit 17 is controlled by an angular rotation sensor 20 associated with main shaft 19, so that the program controlling unit 17 emits the pattern data at the appropriate time.

The program controlling unit 17 can in some embodiments operate in a well-known manner mechanically; for example, with punch cards. Still, an electric design is preferred and the unit may be provided with a data storage device, from which data is accessed twice in each operational cycle. This does not present any problems because the displacement occurs in phases which are clearly separate from each other in the operational cycle.

Figure 2:
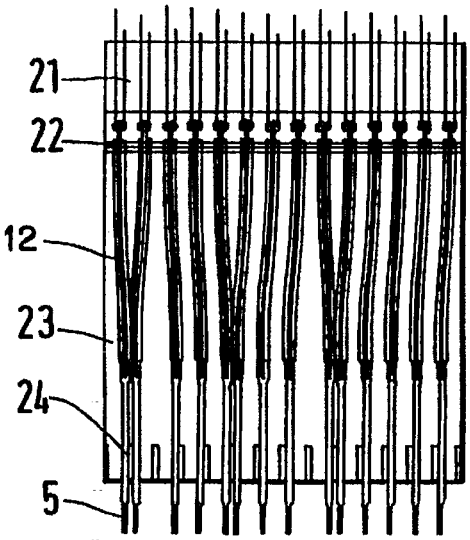
FIG. 2 is a right view of the lower part of the right guide bar shown in FIG. 1.

As shown in FIG. 2, the guides 5, as well as guides 4, are connected to a strip-shaped bending transducer 6, which is attached at its proximal end by means of a retaining device 21 and a cam 22 to a bearing body 23 of guide bar 8. By applying a voltage pulse, as shown in FIG. 3, guides 5 move into their right or left end position, which is defined by virtue of a stop 24 on bearing body 23.

The guide 5 can advantageously remain in one of two end positions, until they are selected for displacement into the other end position. In contrast, the conventional control of Jacquard guides are preliminarily returned in each operational cycle to their starting position, from where they are then displaced. Here, instead, guides 5 are only actuated when the displacement is actually desired, so that the control times can be considerably shortened. As a advantage in high-speed warp knitting machines, guides 5 may then be displaced not just once but rather twice, during one operational cycle.

Figure 3:
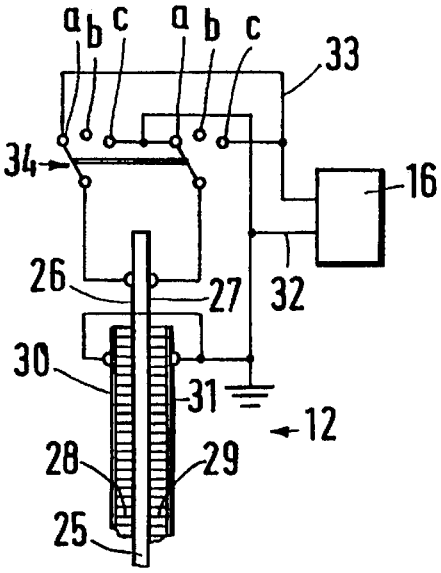
FIG. 3 is a schematic illustration of a portion of a piezoelectric bending transducer.

FIG. 3 illustrates an embodiment of such a bending transducer 12. A bearer strip 25 made from electrically insulating material, for example fiberglass-reinforced synthetic material. Strip 25 is overlaid on both sides with a conductive surface 26 and 27, which are themselves overlaid with piezoelectric layers 28 and 29, respectively. Layers 28 and 29 are covered by electrodes 30 and 31, respectively.

Pulse generator 16 has a grounded output 32 connecting to the electrode surfaces 30 and 31 of bearer strip 25, as well as a pulse output 33, which can be alternately connected to electrodes 26 or 27 desired. To this end, a plurality of switching possibilities are provided, which are symbolized in FIG. 3 by a two-pole 3-position switch 34, in practice however switching is achieved by an electronic circuit. Electrode 26 connects to one pole of switch 34, whose contacts a and c connect to lines 33 and 32, respectively. The other pole of switch 34 connects to electrode 27, while the associated contacts a and c connect to lines 32 and 33, respectively.

With both poles of switch 34 thrown into switching position a as illustrated, the voltage pulse on line 33 is applied to the left electrode 26, so that the left piezoelectric layer is subjected to an electrical field, whereas the right electrode 27 is simultaneously grounded. Consequently, the bearer strip 25 bends and therefore guide 5 deflects to the left. A short pulse is sufficient, because piezoelectric layers 28 and 29 with their electrodes 26 and 27 on the one side and the conductive surface 30 and 31 on the other side form a capacitor. If switch 34 changes to position b after the pulse, voltage is maintained across layers 28 and 29, so that guide 5 does not change its position.

To deflect guide 5 to the opposite end position, switch 34 is moved into position c. With the aid of a short pulse, an electrical field is provided across the right piezoelectric layer 29, whereas the opposite lying electrode 26 is grounded to dissipate any electrical field remaining on left layer 28.

Figure 4:
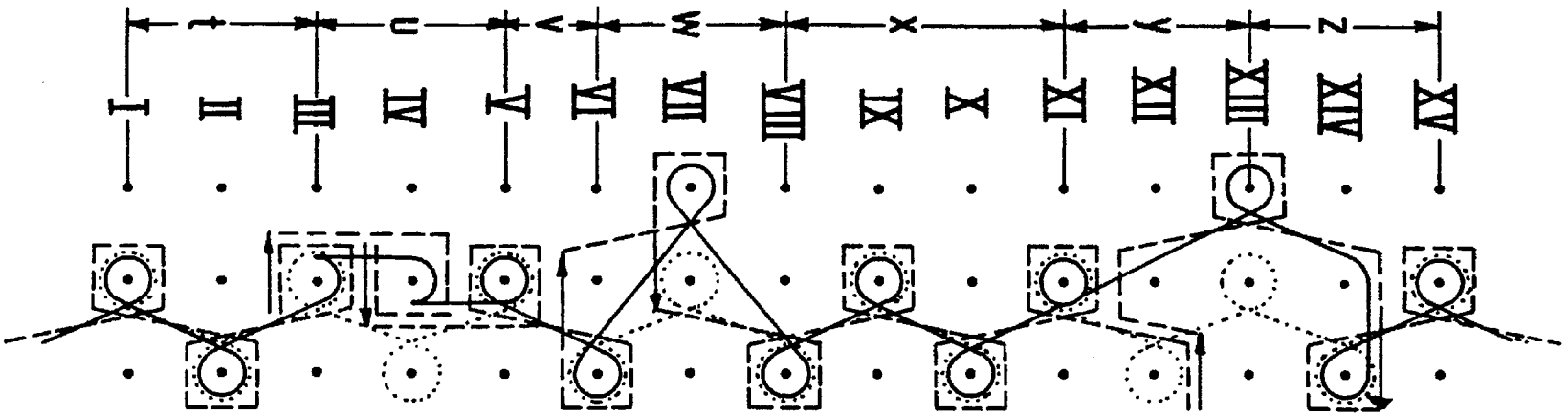
FIG. 4 shows an embodiment of a pattern with a closed lapping.

FIG. 4 illustrates a lapping structure possible with threads guided by guides 5. In this conventional illustration, the points represent the knitting needles 2. The successive pattern movements of the needles are described in the lines I through XV from the bottom upwards. The course just below the needles shows the underlap shogging movement, and the course just above the needles shows the overlap shogging movement. As is known, the threads are guided along the back of the knitting needles during the underlap shog and along the front during the overlap shog.

It is assumed that the displacement of the guide bar, which is effected by the displacement control device 9, produces by itself a basic pattern in the form of a tricot pattern. This tricot pattern is illustrated in the portions t, v and x as the actual patterns (indicated in these regions by the bold unbroken lines). Outside these regions the faint dotted lines illustrate a "normal" tricot pattern; i.e., one undisturbed by individual guide displacement and where all guides 5 are located in the right end position as determined by the left face of the stop 24.

The actual pattern involves individual guide displacements and that more complex pattern is illustrated in the conventional fashion by the unbroken bold line. Since this conventional representation does not clearly show the magnitude of the underlap and overlap shog, a clearer alternative representation is given by the broken bold line. Arrows are added to this alternative representation to show where the guide transfers from one end position to the other (i.e., between stops 24 of FIG. 2). Such displacement arrows appear at the needle rows III, IV, VII, XII and XIV, which produce the course of movement indicated by the bold broken line. Thus, the guide transfers occurring in the underlap region in rows III and IV produces a pillar lap in interval u. The guide transfers in rows VI and VII produce a cloth lap in interval w. The guide transfers occurring in the overlap regions produces an interval y at row XII with a float, and an interval z at row XIV with a twill.

The laps in FIG. 4 are of a closed design. However, they can also be of an open design.

Similar variety occurs if the guide bars 7 or 8 execute a larger basic displacement; for example, should a cloth rather than a tricot pattern be produced using the displacement control device 9. Then, in addition to producing tricot, cloth and velvet, it is also possible to provide a float and/or a twill. It generally applies that underlaps can be produced over n, n+1 and n−1 knitting needle spaces and also provide a float and a twill. If the overlap is greater than one needle space, then the overlap shogging can be shortened or lengthened by one needle space.

A fabric base can be produced with the aid of the guide bar 6. The guide bars 7 and 8 can then be used to produce a special pattern. This base can be, for example, a tricot or, if a further guide bar of a magazine feed device is added, a pillar with a weft or a partial weft.

It is also possible to move the guides using different known methods; for example, by displacing the guides by means of displacement members which are mechanically or electromagnetically actuated (DE-PS 33 21 733) or by swinging the guides by means of a cable pull (DE-PS 41 14 012).

The piezoelectric bending transducers are, however, preferred owing to their high speed. Still this bending transducer can also be of a different construction and be controlled in a different manner. The floating threads can remain for the purpose of forming the pattern, in particular if they are short (1 or 2 rows). They can, however, also be cut off subsequently in a manner known per se.

We claim:

1. Method for manufacturing a warp knitted fabric on a warp knitting machine having on at least one guide bar a plurality of guides displaceable by one needle space additional to an overlap and underlap shog of the guide bar, comprising the steps of:

shogging the guide bar during an overlap and underlap interval in each operational cycle;

displacing during the underlap interval in each operational cycle a first group of the guides selected in dependence upon a predetermined pattern; and displacing during the overlap interval in each operational cycle a second group of the guides in dependence upon the predetermined pattern.

2. Method according to claim 1, wherein the steps of displacing the guides during the underlap and overlap interval are performed by:

displacing the guides to either one of two end positions, while selectively keeping the guides in either of their two end positions until they are selected for displacement between the two end positions in either the underlap or overlap interval.

3. Warp knitting machine comprising:

at least one guide bar;

a displacement control device coupled to said guide bar for displacing said guide bar as a unit;

a plurality of guides mounted on said guide bar for allowing individually selectable displacements of one needle space; and a control device coupled to said guides and having a program controlling unit for selecting in each operational cycle in dependence upon a predetermined pattern ones of said guides, said program controlling unit being operable to select in each operational cycle a first and second group of the guides to be displaced by the control device during underlap and overlap shogs, respectively.

4. Warp knitting machine according to claim 3, wherein the control device comprises:

a plurality of piezoelectric bending transducers each carrying a different corresponding one of said guides.

5. Warp knitting machine according to claim 4, wherein each of the piezoelectric bending transducers have a voltage-holding capacitance, said control device comprising:

an electrical pulse generator coupled and responsive to said program controlling unit for applying electric pulses to the bending transducers of selected ones of said guides.

6. Warp knitted fabric comprising:

a fabric base; and at least one thread system having pattern threads laid in intermixed, varying patterns, said pattern threads comprising underlaps of n, n+1 and n−1 needle spaces, the pattern threads being selectively laid as a float, a twill, or a float and twill.

7. Warp knitted fabric according to claim 6, wherein the pattern threads of said one thread system are selectively formed as cloth, tricot, pillar, float, twill or float and twill.

* * * * *